United States Patent [19]

Paul

[11] 4,013,308

[45] Mar. 22, 1977

[54] ADJUSTABLE STABILIZER

[75] Inventor: David S. Paul, Mississauga, Canada

[73] Assignee: Massey-Ferguson Inc., Detroit, Mich.

[22] Filed: Apr. 14, 1975

[21] Appl. No.: 568,080

[52] U.S. Cl. ..... 280/766; 212/145; 248/357

[51] Int. Cl.[2] ..... B60S 9/12

[58] Field of Search ..... 280/150.5, 763, 766; 212/145; 248/357

[56] References Cited

UNITED STATES PATENTS

| | | | |
|---|---|---|---|
| 2,621,811 | 12/1952 | Lull | 212/145 X |
| 3,007,717 | 11/1961 | Noly | 280/150.5 |
| 3,337,063 | 8/1967 | Testore | 212/145 |
| 3,871,685 | 3/1975 | Senelet | 280/150.5 |
| 3,901,532 | 8/1975 | Hornagold | 280/766 |

OTHER PUBLICATIONS

B583,051, Feb. 1976, Hornagold, 280/145 X.

*Primary Examiner*—Robert R. Song
*Assistant Examiner*—Michael J. Forman
*Attorney, Agent, or Firm*—Thomas P. Lewandowski

[57] ABSTRACT

Stabilizer apparatus for use with a vehicle such as a tractor supporting load handling equipment such as a backhoe in which foot members disposed at opposite sides of a vehicle are engageable with the ground to stabilize the vehicle and are movable to an elevated position for transport by the vehicle. In the ground engaging position the foot members are positioned with their outer extremities projecting beyond some maximum predetermined width of the vehicle and in their transport position occupy a position in which the outer extremities are disposed within the confines of the maximum predetermined width of the vehicle.

11 Claims, 6 Drawing Figures

ADJUSTABLE STABILIZER

BACKGROUND OF THE INVENTION

This invention relates to mobile load handling equipment such as a tractor with a backhoe and more particularly to stabilizers for such equipment.

Mobile load handling equipment such as excavators and backhoes, frequently are mounted on a self-propelled vehicle, such as a tractor, on which the load handling or excavating equipment is supported for transport on the road and for load handling operations during off the road operation.

Usually, such equipment is provided with a stabilizer which engages the ground to support the weight of the vehicle and the loads being manipulated to form a more stable operating platform than can be provided by ground engaging wheels and suspension systems of the vehicle. In the case of a backhoe, for example, such stabilizing equipment is disposed at the rear of the vehicle between the latter and the backhoe equipment and is engageable with the ground at laterally spaced points which serve to resist tilting of the vehicle. The points of engagement with the ground are formed by pads or foot members having a substantial ground engaging, load bearing surface. The structure is usually of a transverse width which will provide a maximum stability for the vehicle and the load handling equipment and at the same time will be no greater than the legal maximum vehicle width which is permitted on a highway. To increase the transverse width of the stabilizer to increase its effectiveness during off the road operation, it is usual to use hydraulically actuated equipment and linkages which are complex and costly or attachments which must be added and subsequently removed for on the road movement of the vehicle.

SUMMARY OF THE INVENTION

It is an object of the invention to provide stabilizer apparatus for load handling equipment such as a backhoe in which the stabilizing structure has one transverse width during vehicle transport and a greater ground engaging width when load handling equipment is being operated.

It is a further object of the invention to provide a stabilizer for load handling equipment employing ground engaging food members which have a given position when they are engaged with the ground and in which portions are automatically moved laterally when the foot member is raised to an elevated position for transport.

Still another object of the invention is to provide stabilizing apparatus for load handling equipment in which the ground engaging width of the stabilizing structure is greater than the transport width and in which the changes in width are automatically accomplished by movement of the foot members between ground engaging and transport positions.

Stabilizing apparatus for mobile load handling equipment has been provided in which ground engaging foot members for supporting the load of the mobile equipment on which the stabilizer apparatus is used are disposed in one position when they are being transported and in a more widely spaced position laterally of the vehicle when they are moved to engage the ground. The stabilizer structure includes vertically movable elevator members which may be manually or hydraulically actuated and to which ground engaging foot members are connected through the intermediary of toggle links so that elevation of the shoe members causes them to assume a position requiring less lateral width. When the ground engaging food members are lowered to a ground engaging position, the foot members are automatically moved to a ground engaging position occupying a greater lateral spacing to increase the stability of the vehicle with which the stabilizing structure is being used.

DETAILED DESCRIPTION

Figure 1:
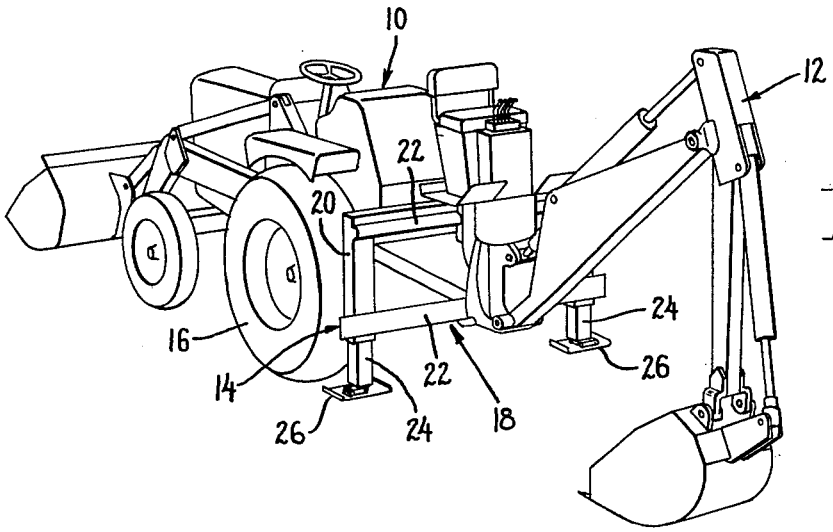
FIG. 1 is a view of a tractor mounted backhoe employing a stabilizer structure embodying the present invention.

Referring to the drawings and particularly to FIG. 1, load handling equipment in the form of a tractor mounted backhoe is illustrated. The equipment includes a tractor 10 and a backhoe 12 mounted on the tractor with a stabilizing structure generally designated at 14 and embodying the invention, supported from the tractor to the rear of the rear driving wheels 16.

The stabilizing structure includes a relatively wide weldment or framework 18 which extends transversely of the vehicle. The framework 18 includes laterally spaced vertical members 20 which are fixed in transversely spaced relationship by upper and lower transverse members 22. The vertical members 20 are substantially identical and are disposed at the left and right side of the vehicle or tractor 10. The vertical members 20 are generally box-like in cross section and can be formed by welding plates together to form a housing for a hydraulically actuated cylinder, the rod end of which is indicated at 24. Alternately the rod end of the cylinder may be attached to a member telescoping with member 20. The hydraulic cylinders are under the control of the operator so that the rod ends 24 may be selectively extended or retracted.

Figure 2:
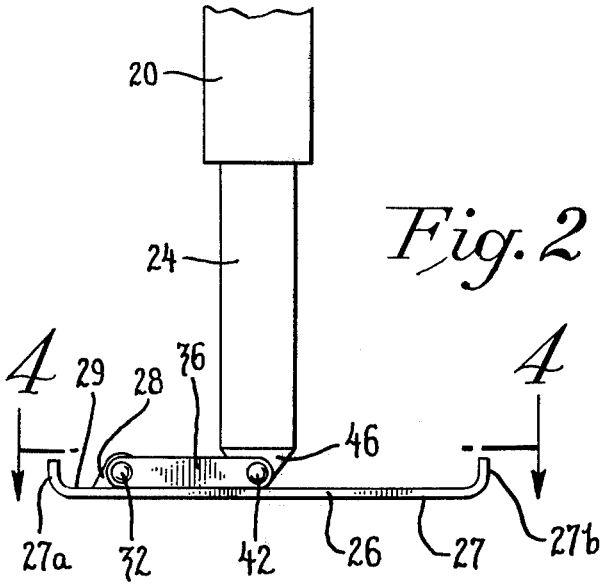
FIG. 2 is a rearward plan view of a portion of the stabilizer structure at one side of the tractor under one condition of operation.
Figure 3:
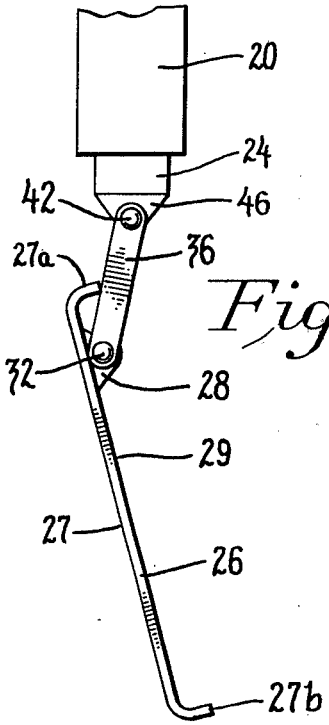
FIG. 3 is a view similar to FIG. 2 but showing an elevated, transport position of a portion of the stabilizing structure.
Figure 4:
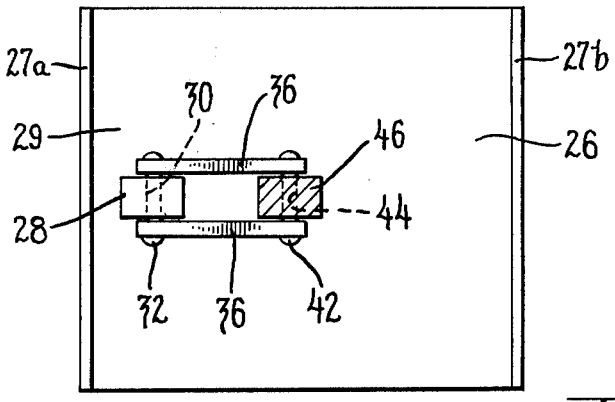
FIG. 4 is a view of a portion of the stabilizing structure taken generally on line 4—4 in FIG. 2.

Referring now to FIGS. 2, 3 and 4, a portion of the stabilizing structure at the left side of the tractor is shown, the structure at the right side being generally identical but a mirror image. The cylinder rod member 24 supports a pad or ground engaging foot member 26 which is generally rectangular in configuration and is preferably formed of a casting or heavy metal plate so that its lower surface 27 provides a large ground engaging surface to act as a bearing support for the load of the vehicle. Opposite lateral edges of the foot member are provided with upturned edge portions **27*a* and 27*b***.

As viewed in FIG. 4, the foot member 26 is provided with a bracket member 28 rigidly connected to an upper surface 29 of the foot member 26 in a position located centrally of the foot member in a longitudinal direction of the tractor and offset outwardly relative to the tractor to one side of the center of the shoe member 26.

The bracket member 28 is provided with a longitudinally extending pin receiving hole 30 which receives a pin 32 pivotally supporting the ends of a pair of link elements 36 disposed at opposite sides of the bracket 28. The opposite ends of the pair of links 36 are provided with apertures which are adapted to receive a pivot pin 42 passing through the ends of the links 36 and an aligned opening 44 in a bracket member 46 rigidly connected to the end of the rod member 24. In the alternative, the bracket member would be attached to the member telescoping into member 20.

In the position shown in FIG. 2, the foot member 26 is disposed so that the lower end of the bracket member 46 is disposed centrally of the foot member 26 in both a fore and aft and transverse direction. The bracket 28 is disposed to one side of the central location a distance determined by the length of the links 36 and the spacing of the pivot pins 32 and 42. This is the ground engaging position of the foot member 26 in which the weight of the vehicle is absorbed centrally of the foot member 26 by engagement of the end of the bracket member 46. The rod member 24 is held in a fixed position by means of the hydraulic circuit, not shown, which locks the rod 24 in a fixed position relative to its cylinder and to the vertical member 20.

To retract the pad or foot member 26 so that the vehicle can be moved to another location or operated on a highway, the piston rod 24 is retracted into its cylinder within the vertical member 20. This causes the links 36 to lift the foot member 26 vertically upwardly so that the links 36 and foot member 26 assume the position shown in FIG. 3. In this position it will be noted that the unbalanced location of the bracket 28 causes the foot member 26 to tilt downwardly relative to the links 36 and the upturned edge 27*a* of the foot member 26 engages an edge of the links 36. The weight of the foot member 26 and the links 36 is pivotally suspended from the pin 42 so that the links 36 and foot member 26 are disposed at an angle to each other and so that the foot member 26 is tilted inwardly and downwardly relative to a vertical plane.

In this position, the foot member 26 occupies a minimum transverse width relative to the vehicle so that none of the structure protrudes outboard or to the left of the vertical member 20 as viewed in FIG. 3. As a result, the outboard side of the vertical member 20 can define the maximum permissible projection of the stabilizer structure to one side of the vehicle. In the transport position, it will be noted that no portion of the foot member 26 projects outwardly of the stabilizer 20 defining the maximum width of the vehicle.

When the vehicle is moved to a working location and it is desired to stabilize the vehicle in a working position, the cylinder rods 24 are extended by hydraulic fluid. When the lower upturned edge 27*b*, as viewed in FIG. 3, engages the ground, the foot member 26, which is disposed at an angle to a vertical plane, is caused to pivot about the ground engaged edge 27*b* relative to the ground. Such pivotal movement causes the pivot pin 32 to swing in an arc carrying with it the lower ends of the links 36 which also are caused to swing outwardly or to the outboard side of the vehicle relative to the pivot pin 42. As the foot member 26 reaches a horizontal position the links 36 also will be disposed generally horizontally and the end of the bracket member 46 will engage the top surface of the foot member 26 so that all further hydraulic force transmitted through the rod member 24 will be transmitted directly to the foot member 26 without imposing larger loads on the links 36 and pins 32 and 42.

It will be noted that in their ground engaging positions the foot members 26 uniformly distribute the weight transferred from the vehicle through the associated piston rods 24 and that the foot members 26 can assume various angles relative to the associated piston rods 24 to accommodate variations in contour of the ground. Also the foot members will have their outer edges extending beyond the maximum transport width of the vehicle to provide a stabilizing platform wider than the vehicle.

Figure 5:
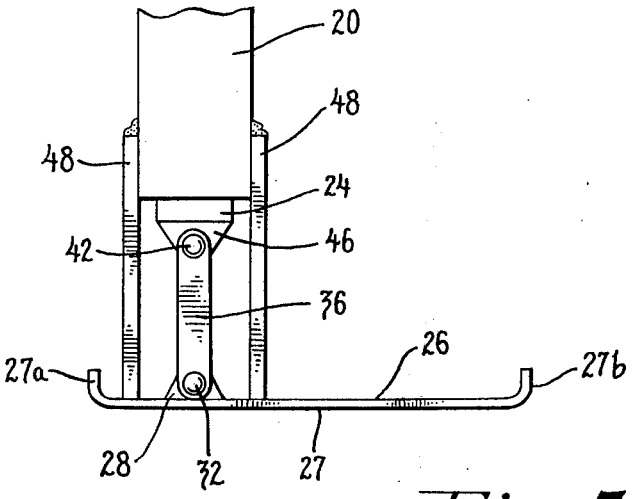
FIG. 5 is a view of locking means for the stabilizer structure of FIG. 1.

FIG. 5 illustrates means for locking the foot member 26 in transport position in the form of lock bars 48 attached to a vertical member 20. The lock bars 48 can be fixedly attached or movable into the locking position because they are engaged naturally as the rod 24 is retracted. If gravity can be satisfactorily relied on, only one lock bar 48 (on the left in FIG. 5) need be provided. The second lock bar prevents movement of the foot member 26 upwardly. As the foot member 26 approaches the lock bar 48 on the left the edge 27*a* will engage the bar 48 first to deflect the foot member 26 into the position illustrated in FIG. 5 with the edge 27*a* adjacent the lock bar 48 and vertical member 20.

Figure 6:
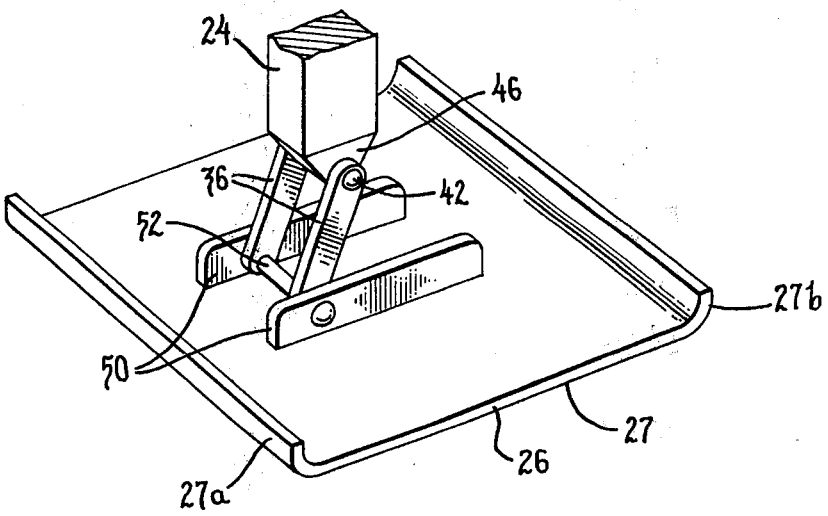
FIG. 6 is an alternate embodiment of the device in FIG. 3.

In FIG. 6 an alternate embodiment is illustrated incorporating support members in the form of support bars 50 welded to the foot member 26. The support members could be webs cast into the plate or like members attached in numerous ways such as by pinning or bolting. The support bars 50 are pivotally connected to the link elements 36 by a pin 52 to support the foot member 26 from the rod 24 in a manner similar to that illustrated in FIGS. 1–4. Additional support in the fore and aft directions is provided by the support members A stabilizer arrangement for mobile load handling machinery is provided in which a foot member for distributing the weight of the vehicle is connected to a vertically movable member in such a manner that in its transport position the foot member occupies a minimum transverse width to minimize the maximum width of the vehicle and in its ground engaging position occupies a maximum transverse width to add to the stability of the vehicle when it is in its machinery working position.

I claim:

1. Stabilizer apparatus for a vehicle supporting load handling equipment comprising: a ground engaging foot member in the form of a generally flat pad, a support and support means movable relative to said support and between an elevated transport position and a lower operating position relative to said vehicles, means connecting said foot member to said support means for moving said foot member from a ground engaging position in which said pad is disposed generally horizontally to occupy a maximum horizontal width to an elevated transport position in which said pad is disposed to occupy a minimum horizontal width including an elongated link having opposite ends pivoted to said foot member and to said support means, respectively, and in which said link is disposed parallel to said pad when the latter is in its ground engaging position and in a position depending from said support means when the latter is in its elevated position.

2. The combination of claim 1 in which said support means engages a central portion of said foot member when the latter is in its said ground engaging position.

3. The combination of claim 1 in which one end of said link is pivoted to said foot member at a location disposed to one side of the transverse center of said foot member.

4. The combination of claim 3 in which said foot member forms a first edge portion engaging said link when said support means is in an elevated position to dispose said foot member and link at an angle relative to each other and said foot member at an angle relative to the ground.

5. The combination of claim 7 in which said foot member has a second edge portion which engages the ground upon movement of said support member from its elevated position to pivot said foot member relative to the ground about said second edge portion.

6. The combination of claim 1 wherein said connecting means includes support members affixed to said foot member for receiving said link therebetween and confining movement between said link and said foot member.

7. Stabilizer apparatus for vehicle mounted load handling equipment comprising: support means disposed at one side of the vehicle and having a portion movable along a vertical axis to selected positions between an elevated transport position and a lower operating position, said support means generally defining a predetermined outer edge of said vehicle, a ground engaging foot member in the form of a flat plate, and means connecting said foot member to said portion of said support means for moving said foot member from a ground engaging position in which the latter is disposed horizontally to occupy a position projecting outwardly of said predeterined edge portion to an elevated transport position in which said foot member is disposed substantially vertically inwardly of said predetermined edge portion, said means connecting said foot member to said support means including a link having a first end pivoted to said support means and a second end pivoted to said foot member at one side of the latter, said link being positioned transverse to the vertical axis of said portion of said support means in the ground engaging position and generally vertical in the transport position.

8. The combination of claim 7 in which said first and second ends of said link about spaced, parallel axes extending longitudinally of said vehicle.

9. The combination of claim 8 in which said axes of said second end of said link is spaced from the transverse center of said foot member a distance equal to the spacing between said axes.

10. The combination of claim 7 in which additional support means is disposed at another side of the vehicle and in which both of said support means are provided with ground engaging foot members.

11. The combination of claim 7 including locking means attached to said support for engaging said foot member as it approaches transport position and moving said foot member inwardly of the width of the vehicle where it is retained by said locking means in a horizontal plane while at the same time retaining said link in a vertical plane.

* * * * *

UNITED STATES PATENT OFFICE

CERTIFICATE OF CORRECTION

Patent No. 4,013,308 Dated March 22, 1977

Inventor(s) David S. Paul

It is certified that error appears in the above-identified patent and that said Letters Patent are hereby corrected as shown below:

Claim 1, line 6, change "vehicles" to --vehicle--.

Claim 5, line 1, change "claim 7" to --claim 4--.

Claim 7, line 15, after "vertically" insert --and--.

Claim 8, line 2, after "link" insert --pivot--.

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*